US005616544A

United States Patent [19]

Kalota et al.

[11] Patent Number: 5,616,544

[45] Date of Patent: Apr. 1, 1997

[54] WATER SOLUBLE METAL WORKING FLUIDS

[75] Inventors: Dennis J. Kalota; Skippy H. Ramsey, both of Fenton; Larry A. Spickard, Chesterfield, all of Mo.

[73] Assignee: Monsanto Company, St. Louis, Mo.

[21] Appl. No.: 624,377

[22] PCT Filed: Oct. 7, 1994

[86] PCT No.: PCT/US94/11645

§ 371 Date: Apr. 1, 1996

§ 102(e) Date: Apr. 1, 1996

[87] PCT Pub. No.: WO95/10583

PCT Pub. Date: Apr. 20, 1995

[51] Int. Cl.[6] ..... C10M 149/00; C10M 173/02

[52] U.S. Cl. ..... 508/508; 508/500; 508/506; 72/42

[58] Field of Search ..... 508/508

[56] References Cited

U.S. PATENT DOCUMENTS

| | | | |
|---|---|---|---|
| 3,046,225 | 7/1962 | Murray et al. | 508/176 |
| 3,280,033 | 10/1966 | Drummond | 508/508 |
| 3,903,005 | 9/1975 | Kablaoui et al. | 508/508 |
| 3,945,931 | 3/1976 | Bussi et al. | 72/42 |
| 4,039,460 | 8/1977 | Koch | 72/42 |
| 4,053,426 | 10/1977 | Davis et al. | 72/42 |
| 4,096,077 | 6/1978 | Swakon | 508/508 |
| 4,144,182 | 3/1979 | Bereuter | 508/508 |
| 4,144,188 | 3/1979 | Sato | 252/389.62 |
| 4,172,802 | 10/1979 | Rieder | 72/42 |
| 4,687,590 | 8/1987 | Haack | 252/75 |
| 4,724,124 | 2/1988 | Ritschel et al. | 508/514 |
| 4,729,841 | 3/1988 | Ritschel et al. | 508/514 |
| 4,938,891 | 7/1990 | Lenack et al. | 508/510 |
| 4,971,724 | 11/1990 | Kalota et al. | 252/390 |
| 5,112,507 | 5/1992 | Harrison | 508/192 |
| 5,142,062 | 8/1992 | Knebel et al. | 548/545 |
| 5,275,749 | 1/1994 | Kugel et al. | 508/508 |
| 5,328,631 | 7/1994 | DuVosel et al. | 510/490 |
| 5,401,428 | 3/1995 | Kalota et al. | 508/508 |

FOREIGN PATENT DOCUMENTS

| | | |
|---|---|---|
| 086513 | 8/1983 | European Pat. Off. . |
| 0400732 | 5/1990 | European Pat. Off. . |
| 63-003098 | 1/1988 | Japan . |
| 2242892 | 9/1990 | Japan . |
| 3181395 | 8/1991 | Japan . |
| 859429 | 8/1981 | U.S.S.R. . |
| 1191114 | 6/1970 | United Kingdom . |
| 2252103 | 7/1992 | United Kingdom . |

OTHER PUBLICATIONS

"Thermal Polycondensation of a–Amino Acids" by S. W. Fox and K. Harada, pp. 127–151, Analytical Methods of Protein Chemistry, date not available.

"Chromate Substitutes for Corrosion Inhibitors in Cooling Water Systems", by Aruna Bahadur, pp. 105–123, Corrosion Reviews vol. 11, Nos. 1–2, 1993 (month N/A).

*Primary Examiner*—Ellen M. McAvoy

*Attorney, Agent, or Firm*—Michael J. Murphy

[57] ABSTRACT

There are disclosed novel water-soluble metal working fluids comprising polyaspartic acid and salts thereof useful as a lubricant in process to cut, bend, grind and shape both ferrous and non-ferrous metal. The polyaspartic acid and salts thereof are particularly advantageous in that the fluids can be easily disposed of after use without special treatment because polyaspartic acid and salts thereof are readily biodegradable.

23 Claims, No Drawings

WATER SOLUBLE METAL WORKING FLUIDS

This invention relates to novel water soluble metal working fluids which are biodegradable and do not require reclaiming. More particularly, this invention relates to polyamido salts useful in cutting, grinding, shaping and other metal working operations which require a lubricant. The disclosed polyamido compounds are also anticorrosive and environmentally more acceptable than current oil based fluids.

BACKGROUND OF THE INVENTION

Because of the concern for environmental factors, previously known oil-containing metal working fluids require reclaiming or disposal other than by discharging them to common sewage treatment systems. In some cases the cost of disposal has become a major cost in that the cost of disposal approaches the initial cost of the fluid.

Metal working fluids fulfill numerous functions in various metal working applications. Typically, such functions include removal of heat from the work piece and tool (cooling), reduction of friction among chips, tool and work piece (lubrication), removal of metal debris produced by the work, reduction or inhibition of corrosion and prevention or reduction of build-up on edges as between the work piece and the tool. This combination of functions usually requires a formulation or combination of ingredients in the fluid to accomplish the best attributes required for a particular metal working operation.

Various fluids have been recently proposed to be substituted for oil-containing metal-working fluids such as primary amides, ethylenediamine tetraacetic acid, fatty acid esters, and alkanolamine salts. Such compounds can be replenished during use by dissolving tablets containing such compounds during the useful life of the fluid. See U.S. Pat. No. 4,144,188 to Sato.

Amines have also been found useful in cutting oils as antibacterial agents. Such amines include anilinoamines and arylalkylamine such a p-benxylaminophenol. See EPO 90-400732 to Noda et al.

As noted above, one of the problems occurring in industry is the proper disposal of metal working fluids. The above mentioned amines are removed from the fluids by biodegradation, requiring facilities such as settling tanks, treatment tanks and sludge treatment tanks. Such a system is disclosed in Japanese Patent 03181395. Other methods of waste disposal and oil removal systems are employed to comply with environmental standards.

Worker sanitation is always an issue with presently employed oil-containing water soluble metal- working fluids. Such fluids unavoidably come in contact with workers using the fluids in cutting, bending, threading and other metal-working applications. Such oil-containing fluids create a mist at the site of the work piece being operated on and such mist travels through the air in the vicinity of the machine and the operator thereof. Some attempts have been made to reduce the mist problem as is noted in British Patent 2,252,103. There is disclosed therein a polymeric thickener comprising a copolymer of acrylamide, sodium acrylate and N-n-octyl acrylamide. The copolymer is formulated with water soluble and water insoluble monomer.

Because of the misting and drift thereof in the work place employing the commonly employed water-soluble metal-working fluids, there is usually associated with such work place a distinctive odor which permeates the entire area. Usually such odor is unpleasant and is tolerated as a condition which is unavoidable.

There is needed a highly biodegradable, odorless, non-misting, water soluble metal working fluid, particularly useful in cutting operations. Such a fluid would dispense with the need for disposal costs, and provide the work place with a more sanitary and acceptable atmosphere in which to work.

Various methods have been discovered to catalyze the polymerization of a dry mixture of aspartic acid to form polysuccinimide. The preferred catalyst to perform in the dry environment is phosphoric acid. While phosphoric acid has been known for many years to be an excellent catalyst for the thermal condensation of aspartic acid, it has traditionally been employed in large quantities so as to form a liquid or pasty mixture. However the use of relatively small amounts so as to maintain a substantially flowable powder is also known. For example, it is disclosed in U.S. Pat. No. 5,142,062 to Knebel et al., that a weight ratio of aspartic/catalyst ratio in the range of from 1:0.1 to 1:2, can be employed. Also, Fox and Harada has published processes for thermal polycondensation of β-amino acids in a publication entitled "Analytical Methods of Protein Chemistry" wherein a procedure is described employing a mole ratio of aspartic/catalyst of 1:0.07. Also, Fox and Harada disclose the use of polyphosphoric acid as a very effective catalyst for the polycondensation reaction of amino acids and indicate that temperatures below that required when o-phosphoric acid is employed are possible.

BRIEF DESCRIPTION OF THE INVENTION

There has now been discovered a highly biodegradable, odorless, non-misting, water soluble metal working fluid comprising polyaspartic polymers selected from the group consisting of the acid, salts and amides derived from the polymerization of aspartic acid. Such polymers are typically produced by the thermal condensation of L-aspartic acid to provide polysuccinimide which is then hydrolyzed by known means to produce the water soluble, highly biodegradable polyaspartic acid or salts. Such polymers commonly have a molecular weight in the range of from about 1000 to about 40,000.

When dissolved in water, such polymers provide a highly desirable water-based metal-working fluid useful in such operations as cutting, threading, bending, grinding, broaching, tapping, planing, gear shaping, reaming, deep hole drilling/gundrilling, drilling, boring, hobbing, milling, turning, sawing and shaping of various ferrous and non-ferrous metals.

DETAILED DESCRIPTION OF THE INVENTION

Typically, the metal-working fluids of this invention comprise polyaspartic acid or a salt thereof in concentrations in the range of from about 3% to about 50%, by weight in water. Preferred compositions of this invention comprise from about 3% to about 15% polyaspartic acid or salt thereof in water.

Since polyaspartic acid or the salts thereof are readily soluble in water there is no need for special processes to incorporate useful amounts. While metal-working fluids of this invention may comprise only polyaspartic acid, a salt or amine thereof in water, it is common practice to include other ingredients which enhance the properties desired in such fluids.

Various additives may be employed in compositions of this invention to enhance or contribute properties which enable broader functions with respect to the use of the compositions in metal working applications. The types of additives include boundary lubricants, corrosion inhibitors, oxidation inhibitors, detergents and dispersants, viscosity index improvers, emulsion modifiers, antiwear and antifriction agents and foam depressors.

For example, additives may be employed to enhance boundary lubrication such as wear inhibitors, lubricity agents, extreme pressure agents, friction modifiers and the like. Typical examples of such additives are metal dialkyl dithiophophates, metal diaryl dithiophosphates, alkyl phosphates, tricresyl phosphate, 2-alkyl-4-mercapto-1,3,4-thiadiazole, metal dialkyldithiocarbanates, metal dialkyl phosphorodithioates wherein the metal is typically zinc, molybdenum, tungsten or other metals, phosphorized fats and olefins, sulfurized fats and olefins and paraffins, fatty acids, carboxylic acids and their salts, esters of fatty acids, organic molybdenum compounds, molybdenum disulfide, graphite and borate dispersions. Such boundary lubrication additives are well knoll in the art. Other additives include detergents and dispersants which provide cleaning functions.

Although the polyaspartic acid compounds of this invention function as corrosion inhibitors in a certain range of pH, corrosion inhibitors may be employed in compositions of this invention which will function in a pH range in which the polyaspartic acid, salt of amide may not function as a corrosion inhibitor. Typical examples of corrosion inhibitors known in the art are zinc chromate, dithiophosphates such as zinc dithiophosphate, metal sulfonates wherein the metal is an alkali metal, alkanolamines such as ethanolamine and substitued alkanolamines wherein the backbone of the alkyl group is substituted to provide various properties, alkyl amines such as hexylamine and triethanol amine, borate compounds such as sodium borate and mixtures of borates with amines, carboxylic acids including polyaspartic acid at high pH (10 and above)and alkyl amido carboxylic acids particularly useful in hard water, sodium molybdate, boric acid ester such as monobenzyl borate and boric acid with various ethanol amines (also acting as a biostat), benzoic acid, nitro derivatives of benzoic acid, ammonium benzoate, hydroxybenzoic acid, sodium benzoate, triethanolamine salts of carboxylic acids with a carboxymethyl thio group such as 1-1-(carboxymethylthio) undecanoic acid triethanol amine salt. A more thorough review of corrosion inhibitors are provided by Aruna Bahadur in a publication entitled "Chromate Substitutes For Corrosion Inhibitors in Cooling Water Systems" appearing in Corrosion Reviews, 11(1–2), pp. 105–122, 1993 which is incorporated herein by reference.

A typical composition of this invention is an aqueous solution containing from about 5% to about 30%, by weight, of the salt or amide of polyaspartic acid together with about 1% to about 10%, by weight, corrosion inhibitor. The composition of this invention may also contain minor amounts of catalyst employed in the thermal condensation reaction of L-aspartic acid whereby the polymer was made. Typically such catalyst is an acid such as phosphoric acid which is converted to the corresponding salt during hydrolysis of the imide polymer.

Typical oxidation inhibitors include zinc and other metal dithiophosphates, hindered phenols, metal phenol sulfides, metal-free phenol sulfides, aromatic amines.

Because many operations in which compositions of this invention are employed create particulates that must be carried away from metal surface, there are employed in compositions of this invention detergents and dispersants. Typical dispersants include polyamine succinimdes, alkylene oxides, hydroxy benzyl polyamines, polyamine succinamides, polyhydroxy succinic esters and polyamine amide imidazolines. Typical detergents include metal sulfonates, overbased metal sulfonates, metal phenate sulfides, overbased metal phenate sulfides, metal salicylates and metal thiophosphonates.

Therefore, compositions of this invention may also include surfactants, extreme pressure agents, buffers, thickeners, antimicrobial agents and other adjuvants commonly employed in such compositions.

The polyaspartic acid of this invention is provided by the thermal condensation of aspartic acid. Many different processes are known for such purpose. For example, there has recently been discovered a continuous process employing a tray dryer wherein the aspartic acid is introduced into the top level of trays which cyclically travel in the horizontal plane to deliver the reacting material to the next adjacent lower level of trays. The residence time in the dryer is controlled by the number of tray levels, circulation of heated gas, such as air, through the dryer, and temperature. The temperature in such a device is usually in the range of from about 200° C. to about 350° C. with a residence time in the range of from about 1.5 to about 3 hours. A typical tray dryer is commercially available from the Wyssmont Company, Incorporated, Fort Lee, N.J. Another tray dryer which may be employed in such process is a tray dryer commercially produced by Krauss Maffe of Florence Ky. In the Krauss Maffe tray dryer, heated trays are stationary and the reactant is moved across each plate by axially rotating plows or shovels. The reactant alternatively falls from one tray level to the next at the internal or external edge of the tray. The reactant is directly heated by the trays.

While there are several isomers of aspartic acid which may be employed to prepare polyaspartic acid, such as D-, L- or DL-aspartic acid, it is preferred herein to employ L-aspartic acid.

If a catalyst is employed the reaction, residence time in the dryer may be less, in the range of from about 1 to about 1.5 hours, depending upon other factors noted above. It has recently been discovered that carbon dioxide in the circulating gas catalyzes the thermal condensation when present in amounts of at least about 5%, by volume. Amounts of carbon dioxide in the circulated gas is usually about 10%, by volume.

Various reactors can be employed to produce the polyaspartic acid of this invention. Typical reactors include the List reactor commercially available from Aerni, A. G. Augst, Switzerland and the Littleford Reactor such as the model FM 130 Laboratory Mixer and larger production models available from the Littleford Bros. Inc., Florence, Ky.

The Littleford mixer provides sufficient agitation to produce a fluid bed condition and may be equipped with a chopper to break up any lumps or clumps of particles that develop and to provide additional shear forces to the fluid bed. The agitation provided by the mixer is sufficient to maintain the particles in a substantially free-flowing state throughout the time period of the reaction. Typically, the Littleford mixer is operated at a temperature of at least about 180° C. and is capable of maintaining the heated bed at a temperature in the range of about 180° C. to about 250° C. or higher for a time sufficient to polymerize the aspartic acid.

The mixer is desirably equipped to provide a purge gas stream through the reactor. In accordance with this invention the gas stream is provided with sufficient amounts of carbon dioxide so as to catalyze the condensation reaction, thus greatly reducing the amount of time to reach complete polymerization of the aspartic acid.

The usual thermal condensation reaction of aspartic acid produces the polysuccinimide intermediate. The intermediate is easily hydrolyzed by alkaline solution to polyaspartic acid or salt. It has been found that a 12%, by weight solution of an alkali metal base, such as sodium hydroxide, optimally converts the intermediate to the desired polyaspartic acid or salt.

Any of the water-soluble salts of the polyaspartic acid produced by the thermal condensation of L-aspartic acid may be employed in the metal-working composition of this invention. Typical salts include alkali metal salts, ammonium, organic ammonium and mixtures thereof. The term "alkali metal" encompasses lithium, sodium, potassium, cesium and rubidium. The organic ammounium salts include those prepared form the low molecular weight organic amines, i.e. having a molecular weight below about 270. Organic amines include the alkyl amines, alkylene amines, alkanol amines. Typical organic amines include propylamine, isopropylamine, ethylamine, isobutylamine, n-amylamine, hexylamine, heptylamine, octylamine, nonylamine, decylamine, undeclyamine, dodecylamine, hexadecylamine, heptadecylamine and octadecylamine.

No matter which reactor is employed, the polyaspartic acid or salt thereof produced by the thermal condensation of L-aspartic acid, is useful in this invention. It has been discovered that this polymer provides sufficient lubrication to permit metal working operations on ferrous and non-ferrous metals. Polyaspartic acid derived from other sources are also useful in the compositions and method of this invention. For example, polyaspartic acid can be derived from the polycondensation processes employing maleic acid or derivatives thereof such as are known from U.S. Pat. Nos. 3,846,380 to Fujimoro et al., U.S. Pat. No. 4,839,461 to Boehmke, U.S. Pat. No. 4,696,981 to Harada et al, all of which are incorporated herein by reference. While not preferred, copolymers of amino acids can also be employed in the process of this invention such as copolymers prepared according to U.S. Pat. No. 4,590,260 to Harada et al.

The water based metal-working fluids of this invention are particularly advantageous in that there is no odor associated with water solutions of polyaspartic acid or salts thereof. Further, it has been observed that the fluid does not create a mist around the tool working area as is common with water-based oil containing fluids. Because of the lack of mist formation the work area is maintained virtually free of deflected fluid leaving the machinery and worker substantially free of contamination by the metal working fluid. The water-based metal-working fluids of this invention are most advantageous in that the active ingredient, polyaspartic acid or salts have been found to have a rapid rate of biodegradation. The biodegradability of the metal working fluids of this invention allows their disposal through normal means as by discharge into a sewage treatment system. The cost advantages of such a fluid are obvious in view of the environmental concerns resulting in alternative means of disposal.

Tests with non-ferrous metals such as brass and copper indicate that not only is the work place relatively free of contamination but that the work piece remains relatively free of discoloring deposits. In fact, it has been observed that the aqueous solutions of the salts of polyaspartic acid are corrosion inhibitors as indicated by U.S. Pat. No. 4,971,724 to Kalota et al.-Therefore, metals, particularly ferrous metals, are free of harmful deposits and are, in fact protected from corrosion by the metal-working fluids of this invention. However the corrosion inhibiting effect of aqueous solutions of polyaspartic acid extend to those solutions having a pH in the range of from about 9 and above. If the formulation employed with the polyaspartic acid or derivative of this invention results in an aqueous solution having a pH of about 10 or below it is recomended that anti-corrosion inhibitors be incorporated into the formulation of the metal-working fluid of this invention. However, during extended use of the fluids in actual practice, the pH of the polyaspartic compositions of this invention tend to decrease due to contact with acidifying agents such as the carbon dioxide in the atmosphere. Therefore, it is common practice to include a corrosion inhibitor in all compositions of this invention. The amount of corrosion inhibitor can vary widely depending upon the particular inhibitor and the enviroment in which the fluid is employed. For example, if zinc chromate is the corrosion inhibitor effective amounts range upwards from as little as 50 ppm.

The metal-working fluids of this invention are useful in the various metal-working applications such as were noted above with any number of types of metals. In particular they are useful in working ferrous metals such as iron, steel (carbon steel and low alloy carbon steel), and stainless steel. Non-ferrous metals which can be worked with fluids of this invention are copper, brass, and aluminum. Such metals are safely worked with lubricity supplied by the water based fluids of this invention.

A particularly important function of a metal working fluid of this invention in cutting operations is the function of cooling so as to maintain lower temperature of the tool as well as the work temperature. Such control aids in minimizing tool wear and distortion of the work piece. Another function of the metal working fluid of this invention is lubrication which reduces friction as between the tool and chips produced during the cutting operation as well as reduction of the friction between the tool and the work piece. In cutting operations of various types there are typically produced chips of small pieces of metal which are advantageously carried away from the work piece as soon as possible so that they do not jam the cutting tool.

DESCRIPTION OF THE PREFERRED EMBODIMENTS

EXAMPLE 1

In the following example, a laboratory model of a tray dryer was employed having two trays which passed the reactant material from one to the other thereby simulating the conditions of a commercially available tray dryer referred to above. The reactant material was passed from one tray to the other so as to equal the desired number of tray levels of the commercial model. The tray dryer, simulating the Wyssmont Turbo Dryer, available from the Wyssmont Company, Fort Lee, N.J. was operated with the addition of 1 kg of L-aspartic acid per tray level at a depth of 2.5 cm on the trays. A total of 28 tray levels was employed. Circulated air temperature through the dryer of 305° C. was maintained throughout the experiment. Air velocity was maintained at 114.3 meters per minute and tray rotation was set at 3 minutes per revolution. An amount of carbon dioxide was fed into the air supply to provide a total amount of 10 percent, by volume, carbon dioxide in the air contacting the material on the trays. Samples were taken from the trays at various reaction times and analyzed for the amount of conversion to polymer, pH, color (APHA), and molecular weight. The data obtained appears in Table I below.

TABLE I

| Sample No. | Time (min) | Mol. wt. | Color | pH | % Conv. Polymer |
|---|---|---|---|---|---|
| 1 | 30 | 9402 | 112 | 9.17 | 53.66 |
| 2 | 64 | 9333 | 471 | 9.82 | 99.00 |
| 3 | 70 | 9263 | 565 | 9.26 | 99.06 |
| 4 | 90 | 8792 | 1069 | 10.01 | 99.16 |

EXAMPLE 2

An important factor in the use of metal working fluids is the amount of foam produced by the action of pumps, sprays and flow of such fluids. To demonstrate the foaming properties of the fluids of this invention a standard ASTM method for foaming properties (D892) was performed. Tests were run with 5% and 28% aqueous solutions of the sodium salt of polyaspartic acid. The test duration was 5 minutes and the data collected at various temperatures and concentrations of polyaspartic acid is shown below in Table II.

TABLE II

| Temp °C. | Cycle | Foam Tendency | Foam Stability |
|---|---|---|---|
| | | 5% Concentration | |
| 24 | 1 | no foam | — |
| 93 | 2 | no foam | — |
| 24 | 3 | no foam | — |
| | | 28% Concentration | |
| 24 | 1 | no foam | — |
| 93 | 2 | no foam | — |
| 24 | 3 | no foam | — |

As indicated by the results of this test, metal working fluids of this invention are virtually free of foaming tendency.

EXAMPLE 3

A Falex test (ASTM D3233B) was run at a fluid temperature of 49° C. at 290 RPM and a concentration of 5%, by weight, of the sodium salt of polyaspartic acid. The data obtained is shown below in Table III.

TABLE IIIA

| 5% Concentration | | | |
|---|---|---|---|
| Load Kgf | Time (min) | Torque - Kgf | |
| 136.8 | 5 | 13.68 | 13.2 |
| 228 | 1 | 20 | 20.9 |
| 342 | 1 | 23.2 | 21.8 |
| 456 | 1 | 24.1 | 23.2 |
| 570 | 1 | 24.1 | 24.2 |
| 684 | 1 | 24.1 | 23.7 |
| 775.2 | 1 | 24.1 | 22.8 |
| 912 | — | 24.6 | — |

There was detected squealing between 300 and 750 Kgf and smoke appeared at 750 kGf and throughout the test. The test was terminated at 2000 lbf load due to load fluctuations and noise. There was 50%, by weight evaporation of the sample and a black tacky build-up was observed on parts. The final liquid temperature was about 54° C.

A second Falex test was run with a working fluid concentration of 28%, by weight, of the sodium salt of polyaspartic acid. The data obtained is shown below in Table IIIB.

TABLE IIIB

| 28% Concentration | | | |
|---|---|---|---|
| Load Kgf | Time (min) | Torque - Kgf | |
| 136.8 | 5 | 24 | 22 |
| 228 | 1 | 30 | 30 |
| 342 | 1 | 38 | 38 |
| 456 | 1 | 42 | 40 |
| 570 | 1 | 49 | 46 |
| 684 | 1 | 51 | 50 |
| 775.2 | 1 | 55 | 53 |
| 912 | 1 | 55 | 55 |
| 1026 | — | 60 | — |

There was detected squealing between 300 and 1250 Kgf and smoking began at 1500 Kgf load and throughout the test. The test was stopped at 1026 lbf load due to load fluctuations and noise. No evaporation or gummy build-up was observed. The final liquid temperature was 70° C.

EXAMPLE 4

A rust test (ASTM D3603) was run with a horizontal disc mild steel coupon. No rust was detected at either 5% or 28%, by weight, aqueous solution concentration of the sodium salt of polyaspartic acid at a pH of 10.2.

EXAMPLE 5

A four-ball wear test was conducted with a 40 kg. force at 1200 RPM at 5% and 28%, by weight, concentrations of the sodium salt of polyaspartic acid. The test was conducted at room temperature for 1 hour. The data collected is presented below in Table IV.

TABLE IV

| Concentration | 5% | 28% |
|---|---|---|
| Initial Temp °C. | 29 | 28 |
| Final Temp °C. | 84 | 57 |
| Ave. Wear Scar Dia. mm | 1.51 | 1.27 |

EXAMPLE 6

A four-ball coefficient of friction test (Falex 6) was run employing 5% and 28%, by weight, concentrations of the sodium salt of polyaspartic acid. The tests were run at 1200 RPM at ambient initial temperature. The data obtained in the tests are shown below in Table V. The result of this test indicates a desirable coefficient of friction for a cutting fluid.

TABLE V

| Time | Temp °C. | | Coefficient of Friction | |
|---|---|---|---|---|
| (min) | 5% | 28% | 5% | 28% |
| 0 | 29 | 28 | 0.077 | 0.072 |
| 10 | | | 0.280 | 0.121 |
| 20 | | | 0.213 | 0.133 |
| 30 | | | 0.175 | 0.087 |
| 40 | | | 0.160 | 0.104 |
| 50 | | | 0.155 | 0.084 |
| 60 | 84 | 57 | 0.170 | 0.100 |
| | | | ave. 0.176 | ave. 0.1 |

EXAMPLE 7

The product of Example 1 was hydrolyzed by a 12% solution of sodium hydroxide. A series of aqueous solutions at various concentrations were prepared from the sodium salt which were subjected to a thermal/hydrolytic stablility test. The test was conducted over a period of 11 days at 78° C. in glass containers. The stability was measured in terms of pH. The results of the test appear in Table VI below.

TABLE VI

| Concentration | pH | | Density -g/ml | |
|---|---|---|---|---|
| %, by wt. | Initial | End | Initial | End |
| 28 | 10.24 | 8.94 | | 1.1651 |
| 20 | 10.22 | 8.93 | | 1.1197 |
| 10 | 10.20 | 8.93 | | 1.0560 |
| 5 | 10.24 | 9.06 | | 1.0261 |

EXAMPLE 8

A seven day stability test was conducted with the sodium salt of Example 7 at a temperature of 78° C. in glass containers. The stability was determined by the change in molecular weight loss over the period. Although some molecular weight loss is indicated in the data, chromatographic analysis of the aged samples did not indicate the appearance of aspartic acid in the test samples. The results of the test are reported below in Table VII.

TABLE VII

| conc | 27% | | 20% | | 10% | | 5% | | control | |
|---|---|---|---|---|---|---|---|---|---|---|
| Day | Mol. Wt | % Poly | Mol. Wt | % Poly | Mol. Wt | % Poly | Mol. Wt. | % Poly | Mol. Wt | % Poly |
| 0 | 9510 | 27.25 | 9510 | 19.69 | 9660 | 9.38 | 8960 | 4.77 | 5360 | 28.5 |
| 1 | 9250 | 26.53 | 9250 | 18.52 | 9110 | 10.02 | 8715 | 5.29 | 5520 | 28.1 |
| 2 | 8936 | 27.4 | 8807 | 20.5 | 8679 | 10.4 | 8250 | 5.3 | 5410 | 28.1 |
| 4 | 8580 | 27.5 | 8460 | 19.4 | 7930 | 9.8 | 7755 | 4.67 | 5320 | 28 |
| 7 | 8410 | 27.99 | 8410 | 20.86 | 7930 | 10.53 | 6640 | 5.25 | 5470 | 28.1 |

EXAMPLE 9

A four-ball wear test (ASTM D2266) was conducted employing a 28% aqueous solution of sodium polyaspartic acid salt. Also tested under the same conditions was a commercially available water based metal working fluid additive sold under the tradename Acusol from Rohm & Haas, diluted to 28% by weight in water. Water alone was also tested for comparison. The load was 40 Kg, the speed was 625 rpm. The test was run at 49° C. for one hour. An average of three readings is reported below in Table VIII.

TABLE VIII

| Lubricant | Polyaspartic | Acusol | Water |
|---|---|---|---|
| Scar Diameter (mm) | 0.54 | 0.50 | 0.70 |

EXAMPLE 10

The metal working fluids of this invention were compared to other fluids in the Four-ball wear test run at 40 Kg load, 1200 rpm and at initial temperature of 48.9° C. for one hour. Four concentrations of the sodium salt of polyaspartic acid as well as alkyl amine salts of polyaspartic acid were compared with other amino acids, commercially available water based fluids, lubricating oil and water emulsions. The results of the test are reported below in Table IX.

TABLE IX

| Lubricant Temp °C. | Concen. (wt. %) | Scar Dia. (mm) | Final |
|---|---|---|---|
| Polyaspartic Acid 53.3 | 28 | 1.39 | |
| 73.9 | 20 | 1.38 | |
| 87.8 | 10 | 1.92 | |
| 87.8[1] | 5 | 1.78 | |
| C18 amine 57.2 | Ksalt 5 mole % | 1.30 | |
| C12 amine 48.9 | 10 mole % | 0.84 | |
| C3 amine diol 48.9 | 10 mole % | 1.06 | |
| PVA[2] 71.1 | 14 | 1.25 | |
| Acusol 445N[3] 48.9 | 28 | 0.98 | |
| Water[4] 98.9 | | 1.47 | |

TABLE IX-continued

| Lubricant Temp °C. | Concen. (wt. %) | Scar Dia. (mm) | Final |
|---|---|---|---|
| Hocut4284b 61.1 | | 1.07 | |
| Eng. Lub 48.9 | | 1.00 | |
| Polyasp Phos Acid 34,600 MW 48.9 | | 1.17 | |
| Triethanolamine 48.9 | 100% | 1.06 | |

[1]amine odor detected
[2]polyvinyl alcohol
[3]a polyacrylate
[4]test concluded after 20 min.

EXAMPLE 11

A lathe, LeBlond Makino model 15-544, was operated at 256 rpm with a carbide coated bit, a series of metal bars (black iron, mild steel, stainless steel and aluminum) were cut with the bit set to cut at a depth of 0.3125 cm. The lubricant employed was a 14% aqueous solution of polyaspartic acid (sodium salt) fed to the bit at the rate of 9.5 l/min. No ripping of the metal was observed and a smooth cut was obtained.

EXAMPLE 12

A series of four-ball tests were run employing various formulated aqueous solutions of polyaspartic acid (PAA). In Table X below are shown the data obtained from the test wherein TSPP means tetrasodium pyrophosphate, CMC means carboxymethylcellulose, and the surfactant is commercially obtained nonionic under the brand name Poly-Tergent, SLF-18. The results of the tests are shown below in Table X. The amounts of components in Table X are in weight percent. The viscosity is reported in centistokes at 37.7° C. and scar diameter is reported in mm. In Table X below LB400 is a commercially available water based additive obtained from Rhone Poulenc Co., Inc. containing polyoxyethylene octadecenyl ether phosphate.

TABLE X

| test | | 1 | 2 | 3 | 4 | 5 | 6 | 7 | 8 |
|---|---|---|---|---|---|---|---|---|---|
| Form | PAA | 5% | 5% | 5% | 5% | 5% | 5% | 5% | 5% |
| | TSPP | | | | | 0.2 | 0.2 | 0.2 | |
| | MORPHOLINE | | | 0.2 | 0.2 | | | 0.2 | 0.2 |
| | CMC | | 6 | | 6.0 | | 6.0 | | 6.0 |
| | LB-400 | | | 0.2 | 0.2 | 0.2 | 0.2 | | |
| | Surfactant | | 0.2 | | 0.2 | 0.2 | | 0.2 | |
| Test Res | viscos 37.8° C. cst. | 1.09 | 1737 | 1.13 | 1828 | 1.13 | 1804 | 1.12 | 2078 |
| | 4-ball test mm | 1.72 | 1.51 | 1.23 | 1.23 | 1.34 | 0.91 | 1.31 | 1.14 |
| | Δ temp °C. | boiled off | 53 | 27.7 | 22.2 | 25 METAL TORE | 27.7 METAL TORE | boiling METAL TORE | 44.4 METAL TORE |
| | Phoenix data | | | | | | | | |
| | 4ball test mm | 1.51 | | | | | | | |
| | Δ Temp °C. | 55 | | | | | | | |

| test | | 9 | 10 | 11 | 12 | 13 | 14 | 14 | 16 | 17 |
|---|---|---|---|---|---|---|---|---|---|---|
| Form | PAA | 20% | 20% | 20% | 20% | 20% | 20% | 20% | 20% | 20% |
| | TSPP | | | | | 0.2 | 0.2 | 0.2 | 0.2 | |
| | MORPHOLINE | | | 0.2 | 0.2 | | | 0.2 | 0.2 | |
| | CMC | | 6.0 | | 6.0 | | 6.0 | | 6.0 | |
| | LB-400 | 0.2 | 0.2 | | | | | 0.2 | 0.2 | |
| | Surfactant | 0.2 | | 0.2 | | | 0.2 | | 0.2 | |
| Test Res | viscos 37.8° C. cst. | 3.48 | 75.02 | 3.4 | 95.12 | 3.35 | 89.17 | 3.39 | 73.49 | 3.33 |
| | 4-ball test mm | 1.45 | 1.05 | 1.56 | 1.42 | 1.39 | 1.18 | 1.24 | 1.1 | 1.53 |
| | Δ temp °C. | 27.7 | 27.7 | 33.3 | 22.2 | 50 | 44.4 | 16.6 | 16.6 | 27.7 |
| | Phoenix data | | | | | | | | | 28% |
| | 4-ball test mm | | | | | | | | | 1.27 |
| | Δ Temp °C. | | | | | | | | | 28.8 |

EXAMPLE 13

An Extreme-Pressure Four-Ball Test was conducted according to the procedure of ASTM D2783, "Standard Method for Measurement of Extreme-Pressure Properties of Lubricating Fluids (Four-Ball Method)". This test is used to rank the relative load carrying properties of lubricating fluids under a constant set of conditions. In this test, one steel ball is rotated under load against three steel balls held stationary. The test lubricant covers the lower three balls. The load is increased on the rotating ball as the test progresses and scar diameter measurements on the balls are made for ten ascending loads below the weld-point. The data is reported in Table XIII below as load wear index (kgf) and weld point (kgf). The load wear index is calculated from the tabulation of scar diameter versus applied load. The corrected applied load (compensating for Hertzian diameter) of the largest 10 loads immediately preceding the weld point are averaged. Since the scar diameters are always measured at the same applied loads, the index becomes a function of the fluid and metals. Since all tests are conducted with the same metal type the load wear index is used to rank the abilities of a series of lubricants to minimize wear. The test data in Table XIII was produced in 3 different laboratories using the same conditions except that Laboratory No. 3 employed a rotation speed of 1800 rpm while Laboratories 1 and 2 employed 1760 rpm. In the table, high molecular weight polyaspartic acid means a polymer of about 38,750 molecular weight. Otherwise, the molecular weight of the polyaspartic acid was in the range of 9,200. In all cases the sodium salt was employed as a result of hydrolysis of the imide polymer.

TABLE XIII

| FLUID TYPE | TEST NUMBER | LOAD WEAR INDEX (kgf) | WELD POINT (kgf) |
|---|---|---|---|
| | LAB NO. 1 | | |
| 28 wt % polyaspartic Salt pH = 10.2 | 4 | 46.3 | 315 |
| 28 wt % polyaspartic Salt pH = 10.2, high MW | 5 | 37.4 | 250 |
| 10 wt % polyaspartic Salt pH = 10.2, high MW | 6 | 33.2 | 250 |
| 10 wt % polyaspartic Salt pH = 10.2 | 7 | 34.4 | 250 |
| 10 wt % polyaspartic Salt pH = 8.5 | 8 | 34.4 | 250 |
| 10 wt % polyaspartic Salt pH = 10.2, 0.2% LB400 | 9 | 32.5 | 200 |
| 10 wt % polyaspartic Salt pH = 8.5, 0.2% LB400 | 10 | 33.5 | 200 |
| 5 wt % polyaspartic Salt pH = 10.2 | 11 | 39.0 | 315 |
| 28 wt % polyaspartic Salt pH = 10.2 (duplicate) | 12 | 47.7 | 315 |

TABLE XIII-continued

| FLUID TYPE | TEST NUMBER | LOAD WEAR INDEX (kgf) | WELD POINT (kgf) |
|---|---|---|---|
| | LAB NO. 2 | | |
| 28 wt % polyaspartic Salt pH = 10.2 | 13 | 68.7 | 500 |
| 28 wt % polyaspartic Salt pH = 10.2 | 14 | 69.0 | 500 |
| 28 wt % polyaspartic Salt pH = 10.2 | 15 | 71.0 | 500 |
| 28 wt % polyaspartic Salt pH = 10.2 | 16 | 70.4 | 500 |
| 28 wt % polyaspartic Salt pH = 10.2 | 17 | 68.6 | 500 |
| | LAB NO. 3 | | |
| 5 wt % polyaspartic salt | 22 | 30.1 | 250 |
| 28 wt % polyaspartic salt | 23 | 41.5 | 250 |
| 5 wt % polyaspartic salt[1] | 24 | 56.9 | 400 |
| 28 wt % polyaspartic salt | 25 | 108.6 | 620 |
| Houghton (5 wt % HOCUT 4284B) | 26 | 46.0 | 126 |
| Houghton - HOCUT 4284B Concentrate | 27 | 48.4 | 126 |

[1]Small amounts of sodium phosphate from catalyst included

EXAMPLE 14

In this example the "Taping Torque Test" was employed which compares metal removal fluids by employing an apparatus particularly suited to obtain the data from comparable runs with different fluids. This method and the apparatus employed to measure the torque during the tapping operation is described by T. H. Webb and E. Holodnik in the Journal of the American Society of Lubrication Engineers, 36, 9, pp. 513–529, September, 1980. The method measures the torque required to tap a thread in a blank speciment nut while lubricated with a metal removal fluid. This torque is measured relative to that torque required to thread a blank specimen while lubricated with a reference fluid. The ratio of the average torque values of the test fluid relative to the reference fluid is defined as the efficiency. The efficiency of two or more fluids can be compared when the average torque values of the reference fluid on different taps are considered statistically equivalent. The metal used in this test was 1018 steel. A commercially available metal removal fluid sold under the trade name "Sulkleer" was employed as the reference and efficiency determined by dividing the torque required when using the commercially available fluid by the torque measured when employing the test fluid multiplied by 100. Lower efficiency is shown by higher torque measured using the test fluid. The data obtained in this test is presented below in Table XIV. The percent efficiency is reported as an average of three runs for each fluid. The sodium salt of polyaspartic acid was tested in aqueous solution and the amount of neutralization is shown by the pH in the table. In each case the polyaspartic polymer is the sodium salt from the hydrolysis of the imide polymer resulting from the thermal condensation of L-aspartic acid.

TABLE XIV

| FLUIDS TESTED | PERCENT EFFICIENCY |
|---|---|
| 10 wt. % polyaspartic salt; 0.2 wt. % LB 400; pH-8.5 | 74.9 |
| 10 wt. % polyaspartic salt; pH-8.5 | 76.1 |
| 10 wt. % polyaspartic salt; pH-10.5 | 70.1 |
| 28 wt. % polyaspartic salt; pH-10.2 | 68.7 |
| 10 wt. % polyaspartic salt; pH-10.2; 0.2 wt. % LB 400 | 74.8 |
| 5 wt. % polyaspartic salt; pH 10.2 | 68.5 |
| 10 wt. % polyaspartic salt; pH 10.2 | 72.6 |
| 28 wt. % polyaspartic salt (high mol. wt.); pH-10.2 | 76.1 |
| 10 wt. % polyaspartic salt; (low mol. wt.) pH-10.2 | 73.4 |
| Commercial Cutting Oil[1] | 95.5 |
| Commercial Cutting Oil[2] | 80.5 |
| Reference Oil | 100 |

[1]Marketed by Sahara Oil Co. of America, under the trade name "Tool Saver M.S."; CAS No. 64742-54-7; a petroleum hydrocarbon.
[2]Marketed by Engineered Products Co., Maryland Ht., MO under the trade name Ensol E. M-1-P-1, a petroleum hydrocarbon mixed with water in a weight ratio of 1 part to 20 of water.

All of the polyaspartic acid solution test results are in the range of the results found for Commercial Cutting Oil[2] indicating that the polyaspartic acid fluids are comparable in operation. Also, variables such as molecular weight, concentration(5% vs. 28%) and lubricity additive LB-400 have virtually no effect on tapping ability as measured by this test.

As shown by the data in Table XIII, Lab. No. 3, the polyaspartic solutions of this invention provides very high weld points compared to the commercially available cutting fluid. These data indicate that compositions of this invention are highly useful in metal forming operations.

Although the invention has been described in terms of specific embodiments which are set forth in considerable detail, it should be understood that this description is by way of illustration only and that the invention is not necessarily limited thereto, since alternative embodiments and operating techniques will become apparent to those skilled in the art (in view of the disclosure.) Accordingly, modifications are contemplated which can be made without departing from the spirit of the described invention.

What is claimed is:

1. A metal working composition comprising an aqueous solution of a polyaspartic polymer selected from the group consisting of the acid, salt and amide thereof wherein the concentration of said polymer is in the range of from about 0.5% to about 70% and a corrosion inhibitor in amount effective to prevent substantial corrosion at a pH of the solution where the polyaspartic polymer does not function as corrosion inhibitor.

2. The composition of claim 1 wherein the corrosion inhibitor is present in the range of from about 50 ppm to about 15 percent by weight.

3. The composition of claim 2 wherein the concentration is in the range of from about 5% to about 10%.

4. The composition of claim 2 wherein the concentration of the corrosion inhibitor is in the range of from about 1 percent to about 10 percent by weight.

5. The composition of claim 1 further containing an adjuvant.

6. The composition of claim 1 wherein the polymer is an alkali metal salt.

7. The composition of claim 6 wherein the salt is a sodium salt.

8. The composition of claim 6 wherein the polymer is an amide.

9. A metal working composition of claim 1 wherein the corrosion inhibitor is a salt of benzoic acid.

10. A metal working composition of claim 9 wherein the corrosion inhibitor is selected from the group consisting of sodium benzoate and ammonium benzoate.

11. The composition of claim 1 wherein the pH of the solution is less than 10.

12. The composition of claim 1 further including a minor amount of sodium phosphate.

13. The composition of claim 1 wherein the molecular weight of the polyaspartic polymer is about 1000 to about 40,000.

14. The composition of claim 1 wherein the polyaspartic polymer is potassium polyaspartate.

15. The composition of claim 11 further including a boundary lubrication additive.

16. The composition of claim 11 further including an antifriction agent.

17. The composition of claim 14 wherein the molecular weight is between 8792 and 9402.

18. A metal working composition comprising an aqueous solution of sodium polyaspartate having a pH in the range of from about 8.5 to about 10, a minor amount of sodium phosphate and a corrosion inhibitor in amount effective to prevent substantial corrosion at a pH of the solution where the polyaspartate does not function as corrosion inhibitor.

19. A metal working composition of claim 18 wherein the sodium polyaspartate is present in the range of from about 5 to about 30 percent by weight.

20. A mental working composition of claim 19 wherein the corrosion inhibitor is present in the range of from about 1 to 10 percent by weight.

21. A metal working composition of claim 20 wherein the corrosion inhibitor is selected from the group consisting of sodium benzoate and ammonium benzoate.

22. The composition of claim 18 wherein the molecular weight of the sodium polyaspartate is about 1000 to about 40,000.

23. The composition of claim 22 wherein the molecular weight is between 8792 and 9402.

* * * * *